United States Patent [19]

Kawara et al.

[11] Patent Number: 5,046,249

[45] Date of Patent: Sep. 10, 1991

[54] MOTOR DRIVEN OSCILLATING RAZOR

[75] Inventors: Manabu Kawara, Otsu; Masao Tanahashi; Masao Matsumoto, both of Hikone, all of Japan

[73] Assignee: Matsushita Electric Works, Ltd., Japan

[21] Appl. No.: 555,637

[22] Filed: Jul. 23, 1990

[30] Foreign Application Priority Data

Aug. 19, 1989 [JP] Japan ..... 1-214012
Dec. 25, 1989 [JP] Japan ..... 1-335470

[51] Int. Cl.[5] ..... B26B 19/28; B26B 19/38; B26B 21/16

[52] U.S. Cl. ..... 30/45; 30/44; 30/86

[58] Field of Search ..... 30/42, 43.3, 43.7, 43.8, 30/43.91, 44, 45, 49, 87, 89, 458, 461

[56] References Cited

U.S. PATENT DOCUMENTS

| | | | |
|---|---|---|---|
| 3,611,568 | 10/1971 | Alexander et al. | 30/45 |
| 3,636,627 | 1/1972 | Tiffin | 30/45 |
| 3,772,779 | 11/1973 | Douglass et al. | 30/45 |
| 4,083,102 | 4/1978 | Harshberger | 30/45 |
| 4,744,144 | 5/1988 | Lowery, Sr. et al. . | |
| 4,819,330 | 4/1989 | Fenn et al. . | |
| 4,914,816 | 4/1990 | Fenn et al. | 30/45 |

*Primary Examiner*—Paul A. Bell
*Assistant Examiner*—Paul M. Heyrana, Sr.
*Attorney, Agent, or Firm*—Stevens, Davis, Miller & Mosher

[57] ABSTRACT

An improved hand-held motor-driven oscillating razor for wet shaving provides a substantially vibration-free gripping during the shaving. The razor comprises a grip housing adapted to be gripped by the hand of a user and a shaver head movably supported on top of the grip housing. The shaver head carries a razor blade element and includes a weight which is driven by a motor to impart oscillatory movement to the shaver head. The motor is mounted within the shaver head together with the weight so as to confine an oscillatory system within the shaver head. A damper member is utilized to singly support the shaver head to the grip housing in order to made the shaver head movable with respect to the grip housing such that the grip housing can be isolated substantially from the oscillatory system in the shaver head, permitting the shaver head to oscillate substantially indpendently of the grip housing, thereby minimizing a counter-vibration transmitted back to the grip housing from the shaver head. The damper member is preferably configured to exhibit different elasticity in differing directions in order to minimize the counter vibration which the user feels during the shaving, while assuring effective shaving.

10 Claims, 8 Drawing Sheets

MOTOR DRIVEN OSCILLATING RAZOR

BACKGROUND OF THE INVENTION

1. Field of the Invention

The present invention is directed to a motor driven oscillating razor having a shaver head with a razor blade element which is driven by the motor to oscillate for comfortable and effective wet shave.

2. Description of the Prior Art

A number of oscillating razors have been proposed in the art in which a razor blade or blades are oscillated to provide effective or close shave. Typical prior art oscillating razor is seen in U.S. Pat. No. 4,744,144 which comprises a tubular grip housing with razor blades at its upper end. The grip housing accommodates therein an eccentric weight and a motor which rotates an eccentric weight so as to impart oscillatory movement to the whole grip housing. In this patent, since not only the razor blades but also the grip housing oscillates, an oscillatory system is required in the razor which generates a relatively great oscillatory energy in order to oscillate the razor blades together with the grip housing at a desired amplitude and frequency. Such oscillatory system must, therefore, includes physically large components, i.e., weight, motor and the other associated parts, which are likely to interfere with each other during the oscillation to thereby produce a loud noise. Further, since the grip housing itself is subject to the oscillation, the user holding the grip handle is constantly suffering from the oscillation or counter-vibration during the shaving, which is not acceptable in view of obtaining comfortable shaving and therefore hinders the widespread use of the oscillating razor of this kind.

Another prior art razor is seen in U.S. Pat. No. 4,819,330 in which a shaver head is coupled to the top of a grip housing with a resilient bushing interposed therebetween so that the shaver head can be movably mounted on the grip housing. The shaver head carries a razor blade or blades and accommodates therein a weight which is driven to reciprocate through a rotary-to-oscillation conversion mechanism also accommodated within the shaver head to impart oscillatory movement to the shaver head. Thus, the shaver head can oscillate in unison with the razor blades relatively freely with respect to the grip housing. Accordingly, it is possible with the structure of this patent to reduce the counter-vibration transmitted back to the grip housing from the shaver head. However, in this patent, because of that a motor driving the weight is still accommodated in the grip housing and that the shaver head is has its lower end inserted to an upper opening of the grip housing for connection therebetween with the resilient busing closely confined at the connection, there remains a problem that the motor will be a cause of giving a vibration to the grip housing as well as that the resilient bushing is not expected to effectively absorb the vibration of the shaver head, thus leaving a significant counter-vibration to be transmitted back to the grip housing. Therefore, this prior art device is still unsatisfactory in minimizing the counter-vibration as much as possible which the user feel during the shaving.

SUMMARY OF INVENTION

To eliminate the above insufficiencies and problems, the present invention provides an improved oscillating razor which gives substantially vibration-free gripping. The oscillating razor in accordance with the present invention comprises a grip housing adapted to be gripped by the hand of a user and a shaver head carrying a razor blade element and accommodating therein an oscillation inducing weight. A damper member is provided to couple the shaver head on top of the grip housing so as to singly and movably support the shaver head with respect to the grip housing. The weight is operatively connected to a motor and driven thereby to impart oscillatory movement to the shaver head so that the shaver head and the razor blade element can oscillate together with respect to the grip housing. The characterizing feature of the razor resides in that the motor is accommodated within the shaver head together with the weight in order to isolate an oscillatory system substantially from the grip housing through the damper member such that the shaver head can oscillate substantially independently of the grip housing, whereby minimizing counter-vibration transmitted back to the grip housing from the shaver head.

Accordingly, it is a primary object of the present invention to provide an improved oscillating razor which is capable of confining the oscillatory system within the shaver head to minimize counter-vibration transmitted back to the grip housing from shaver head, thereby greatly reducing the counter-vibration which the user feel during the shaving and consequently assuring a comfortable shaving with the grip housing held by one hand of the user.

In a preferred embodiment, the damper member is configured to exhibit less elastic modulus in the lengthwise direction of the razor blade element than in the edgewise direction thereof, or a direction perpendicular to the lengthwise direction. In other words, the damper member has greater dampening effect for the oscillation occurring in the lengthwise direction of the razor blade element than in the edgewise direction thereof. With this result, the damper member can well absorb the counter-vibration occurring in the lengthwise direction and transmitted back to the grip housing, while it can make the most of less flexible characteristic in the edgewise direction so as to positively support the shaver head and at the same time to allow the shaver head to oscillate in the edgewise direction for assuring effective shaving. This is particularly advantageous when considering a manner in which the user hold the razor during the shaving. That is, most of the user will hold the grip housing at its opposite sides along the lengthwise direction of the razor blade element by his fingers, i.e., thumb, index and middle fingers, and accordingly will be most sensitive to the counter-vibration occurring in the lengthwise direction. Consequently, by reducing the counter-vibration in that direction, the user will experience only minimum vibration at the fingers of the hand holding the grip housing and can enjoy very comfortable shave substantially free from the counter-vibration.

It is therefore another object of the present invention to provide an improved oscillating razor in which the shaver head is supported to the grip handle by means of the damper member exhibiting direction-dependent elasticity in order to minimize the counter-vibration being felt by the user for comfortable shaving, yet assuring effective shaving with the help of the forced oscillation of the shaver head occurring in the edgewise direction.

In one embodiment, the damper member is provided in the form of a hollow cylinder having upper and lower ends connected respectively to the shaver head and the grip housing and having a neck portion intermediate the ends which is exposed between the shaver head and the grip housing to be responsible for movable support of the shaver head. To obtain the above direction-dependent elasticity, the neck portion is substantially uniform in thickness and configured to have a less inside diameter along the lengthwise direction of the razor blade element than along the edgewise direction thereof.

In another embodiment, the damper member is likewise configured into a like hollow cylinder with a like neck portion of substantially uniform thickness. The neck portion is configured to have an outside diameter which is smaller along the lengthwise direction of the razor blade than along the edgewise direction of the razor blade to obtain a desired direction-dependent elasticity.

The damper member is preferably configured to have an integral annular outer flange at the neck portion which restricts elastic deformation range of the damper member itself in order to avoid excessive deformation of the shaver head substantially in all directions with respect to the grip housing. With the provision of the annular flange, the damper member can be protected from excess deformation which may result from a large deformative force applied to the shaver head and eventually break or damage the damper member.

It is therefore a further object of the present invention to provide an improved razor which is capable of protecting the damper member from excessive deformation to thereby keep stably supporting the shaver head for assuring a long-life use or shaving.

These and still other objects and advantageous features of the present invention will become more apparent from the following description of the preferred embodiments of the present invention when taken in conjunction with the attached drawings.

DETAILED DESCRIPTION OF THE EMBODIMENTS

First Embodiment <FIGS. 1 to 4>

Figure 1:
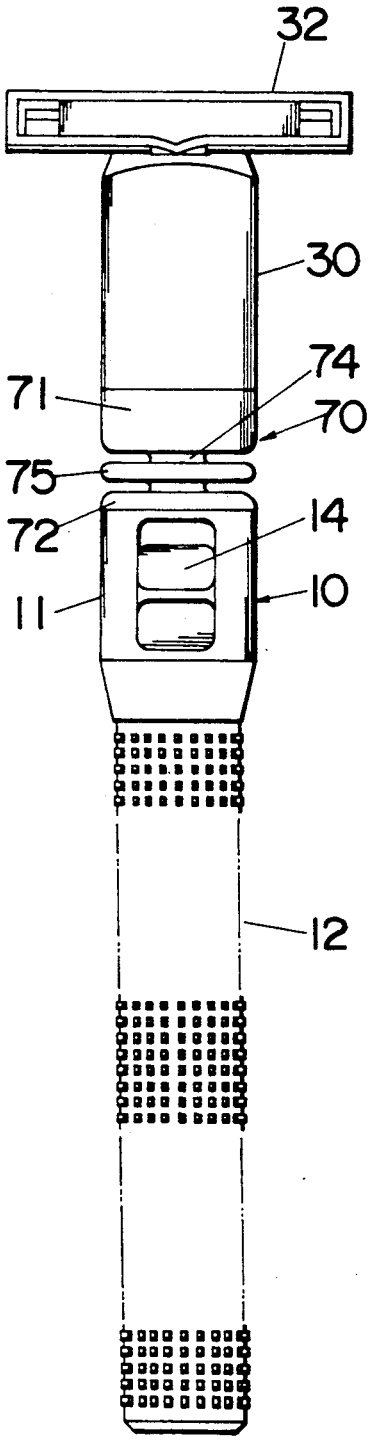
FIG. 1 is a front view of an oscillating razor in accordance with a first embodiment of the present invention.
Figure 2:
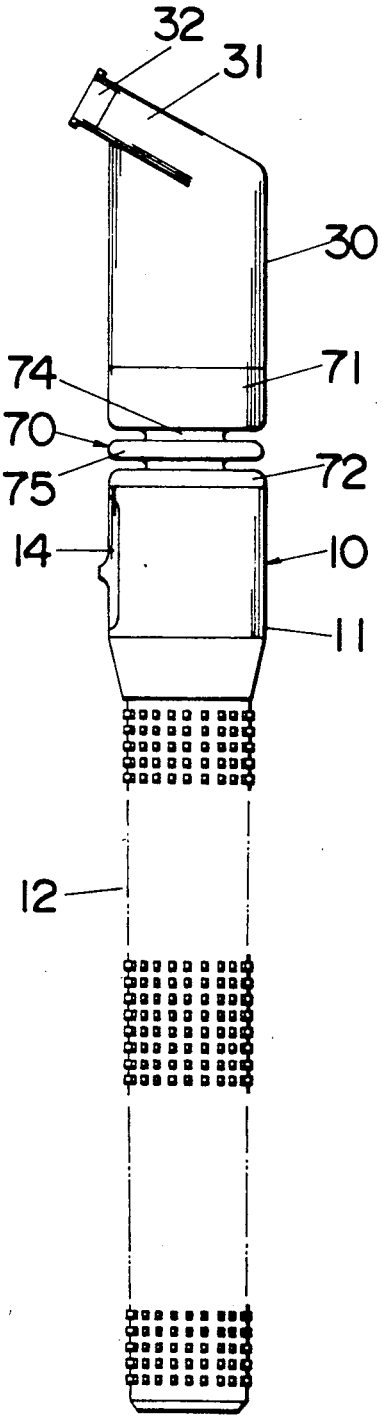
FIG. 2 is a side view of the oscillating razor.

Referring now to FIGS. 1 and 2, there is shown an oscillating razor in accordance with a first embodiment of the present invention. The oscillating razor comprises a grip housing 10 and a shaver head 30 carrying a standard blade cartridqe 40 of widely available configuration having single or twin blade element (not seen in the figure). The grip housing 10 is of generally cylindrical configuration adapted in use to be gripped by the fingers of a user and comprises a base barrel 11 and a cylindrical battery holder 12. The shaver head 30 is of generally cylindrical configuration with an integral nose 31 extending upwardly and forwardly at an angle of about 45° with respect to a vertical axis of the shaver head 30. Formed at the end of the nose 31 is a mount socket 32 for detachably mounting the blade cartridge 40 in such a manner that the blade element extends horizontally in a perpendicular relation to a vertical axis of the shaver head 30. The shaver head 30 is supported to the top of the grip housing lo by means of a damper member 70 so that it is movable with respect to the grip housing lo within a limited range, and is normally held in an upright position where the vertical axis of the shaver head 30 is substantially aligned with a vertical axis of the grip housing 10.

Mounted within the shaver head 30 is an electric rotary motor 50 having an output shaft 51 extending vertically upwardly to carry an eccentric weight 52. The motor 50 is held in position between an internal shoulder 33 of the shaver head 30 and a ring 34 fitted in the lower end of the shaver head 30. The motor 50 is powered by a pair of batteries 60 held in tandem arrangement within the battery holder 12 to rotate the eccentric weight $z for imparting an oscillatory movement to the shaver head 30 and consequently the blade element with respect to the grip housing 10. Preferably, it is desired to generate the oscillation at 10,000 to 30,000 strokes per minute [spm]with an amplitude of 0.15 mm to 0.30 mm. Such oscillation is determined by suitably selecting the rotational speed of the motor 50, eccentricity and mass of the weight 52. A vertically slidable switch handle 14 is mounted on the base barrel 11 to actuate an actuator 15 in the base barrel 11 for electrical connection and disconnection of the motor 50 to and from the batteries 60. Mounted within the base barrel 11 is a terminal block 20 carrying a set of switch contacts connected to the batteries 60 through terminal 22, and lead wires 23 extending through the damper member 70 into the shaver head 30 for electrical connection with the motor 50. The upper end of the battery holder 12 is threaded into the bottom opening of the base barrel 11 with a seal ring 16 fitted therebetween for water-tight sealing.

The damper member 70 is made of rubber or elastomer into a hollow cylinder having upper and lower ends 71 and 72 respectively secured to the lower end of the shaver head 30 and the upper end of the base barrel 11.

Figure 3:
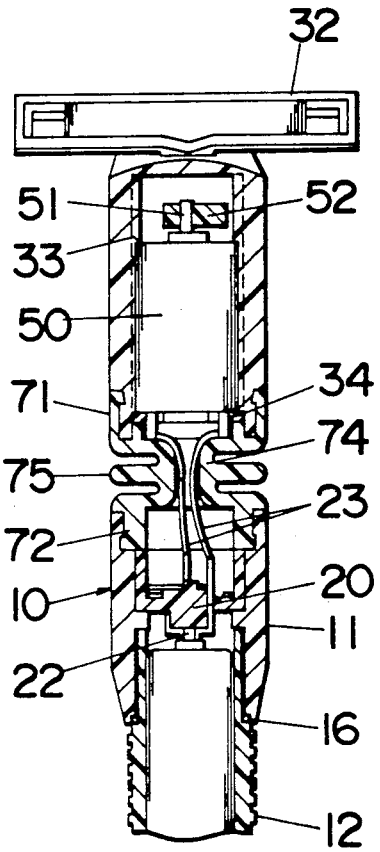
FIG. 3 is a front vertical sectional view of a portion of the razor.
Figure 4:
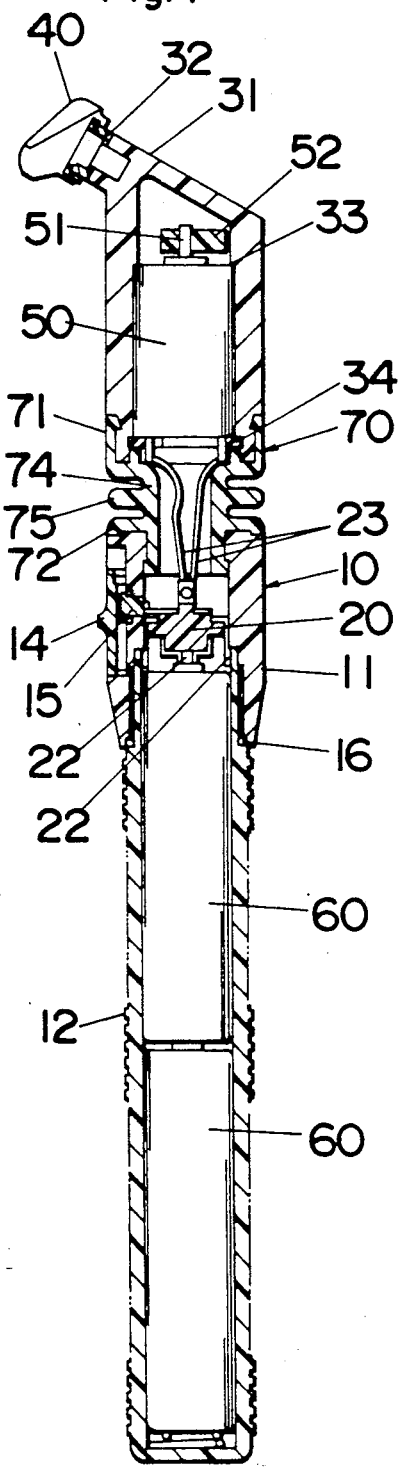
FIG. 4 is a side vertical sectional view of the razor.

The damper member 70 is formed at a portion intermediate between the ends 71 and 72 With a reduced-in-diameter neck portion 74 which is exposed between the shaver head 30 and the grip housing 10. It is this neck portion 74 that exhibits elasticity for movably supporting the shaver head 30 onto the grip housing 10 and allowing the shaver head 30 to move substantially in all direction with respect to the grip housing 10. The neck portion 74 is formed to have substantially the same thickness around its periphery and is specially designed into a somewhat ellipse configuration having a less internal diameter along the lengthwise direction of the blade element than in a direction perpendicular thereto, i.e., the edgewise direction of the blade element, as shown in FIGS. 3 and 4, such that the damper member 70 exhibits at the neck portion 74 a less elastic modulus in the lengthwise direction of the blade element (i.e., in the plane of FIG. 3) than in the edgewise direction (i.e., in the plane of FIG. 4). Whereby, the damper member 70 is enabled to absorb the counter-vibration which is transmitted back from the oscillatinq shaver head 30 to the grip housing 10 and occurs in the lengthwise direction of the blade element by a greater extent than that occurring in the edgewise direction.

It should be noted at this time that, due to the requirement of positively supporting the shaver head 30 to the grip housing 10, the damper member 70 as a whole must have a rather stiff characteristic or reduced elasticity yet retaining sufficient elasticity allowing the blade element and the shaver head to oscillate for effective shaving, although it is required to minimize the counter-vibration which the user feels during the shaving. To satisfy the above requirements, it is firstly considered that the shaver head and the blade element is preferred to oscillate in the edgewise direction of the blade element rather than in the lengthwise direction in order to obtain effective or close shave. Secondly, an analysis is made as to a manner in which the user will manipulate the razor during the shaving in order to evaluate which oscillation is most sensitive to the user, i.e., which oscillation is seriously felt by the user. The analysis reveals that most of the users will hold the opposite sides of the grip housing along the lengthwise direction of the blade element between the thumb and index finger and middle finger. Consequently, it is found that reducing the counter-vibration in the lengthwise direction will effectively and greatly minimize the counter-vibration which the user feels during the shaving. Therefore, it is possible to satisfy the above two requirements by configuring the damper member 70 to exhibit less elastic modulus in the lengthwise direction of the blade element than in the edgewise direction such that the counter-vibration in the lengthwise direction can be well absorbed in the damper member 70 to minimize the counter-vibration which the user feels at the grip housing 10, while the damper member 70 exhibits rather greater elastic modulus in the edgewise direction so as to positively support the shaver head 30 and to allow the shaver head 30 to oscillate in the edgewise direction for effective shaving.

Although the reduced elastic modulus of the damper member 70 in the lengthwise direction may appear to enhance the oscillation of the shaver head 30 and therefore the blade element in that direction, the oscillation of the blade element in that direction will not be so enhanced as to prevent excess oscillation leading to injure the skin because of the elongated and symmetrical configuration of the blade cartridge about the vertical axis of the shaver head 30 makes it more reluctant to oscillate in the lengthwise direction than in the direction perpendicular thereto along which the blade cartridge is asymmetrical about the vertical axis of the shaver head 30. Consequently, the blade element can oscillate generally in the edgewise direction thereof so as to assure effective shaving, yet maintaining the lengthwise oscillation within an acceptable level. In view of the above, the damper member 70 is preferably designed to exhibit an elastic modulus of 20–30 g/m in the lengthwise direction and that of 40–50 g/m in the edgewise direction. Although the damper member 70 is preferred to have the differing direction-dependent elasticity by the reason discussed in the above, the present invention should not be understood to be limited thereto and may use a damper member having a substantially uniform elasticity in those directions since the damper member serves to singly support the shaver head and therefore can absorb the counter-vibration in the lengthwise and the edgewise directions. Further, in the above embodiment, the damper member is made to exhibit the differing elastic modulus by differentiating the inside diameters along the different directions rather than the thickness thereof to retain the feasibility of fabricating the damper member, it is of course possible to give such differing elasticity by other designs.

The damper member 70 is additionally formed with an outside annular flange 75 extending around the entire circumference thereof at a vertically middle of the neck portion 74 in order to prevent an excessive deformation of the damper member 70, or prevent it from buckling when the shaver head 30 receives an unusual external deformative force other than the oscillatory force. Therefore, the damper member 70 can be well protected being damaged or collapsed even when the razor is accidentally dropped to the floor, thus stably supporting the shaver head 30 on the grip housing 10.

It is noted at this time that since the damper member 70 of rubber or elastomer has its upper and lower ends connected directly respectively to the grip housing 10 and the shaver head 30, these ends can be best utilized to effect the water-tight seal between the shaver head 30 and the grip housing 10.

Second Embodiment <FIGS. 5 to 17>

Figure 5:
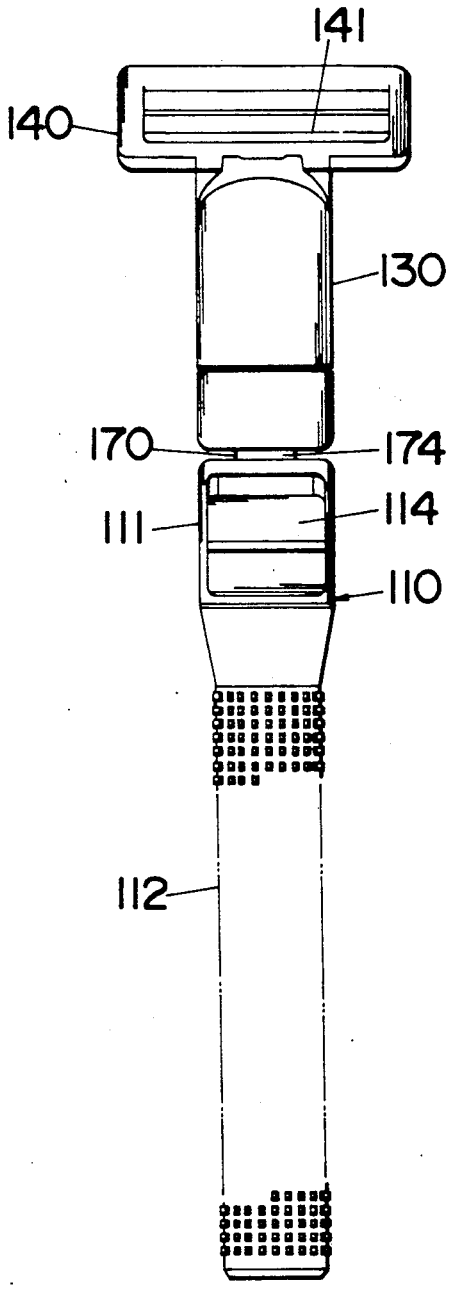
FIG. 5 is a front view of an oscillating razor in accordance with a second embodiment of the present invention.
Figure 6:
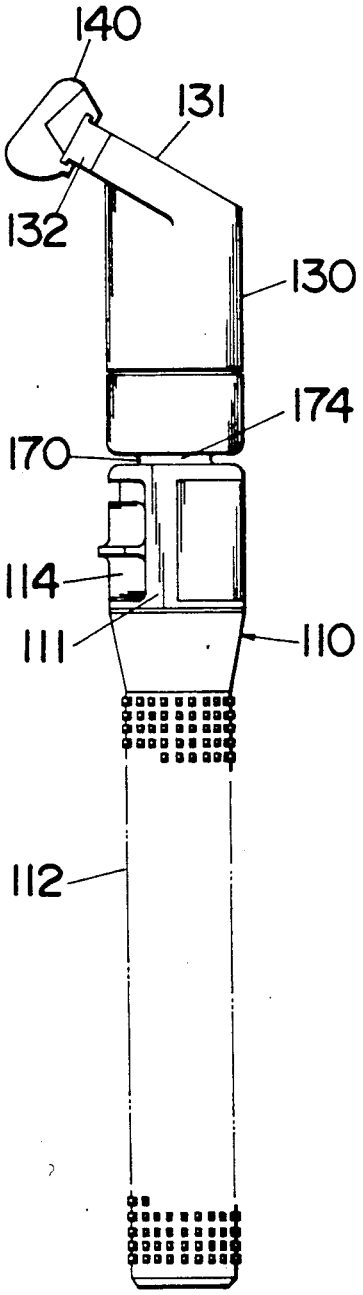
FIGS. 6 to 8 are respectively side, rear, and bottom views of the razor.
Figure 7:
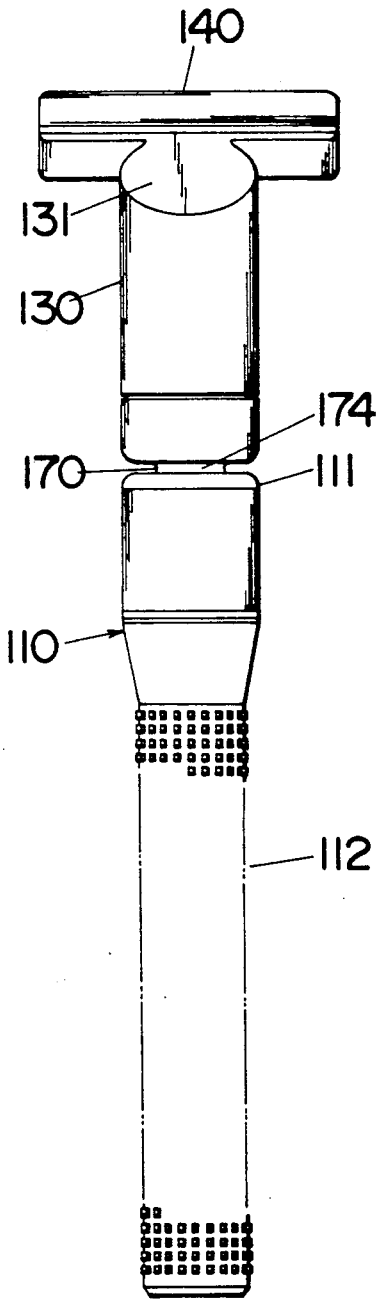
Figure 8:
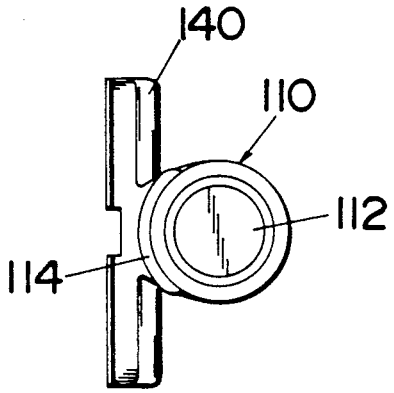
Figure 9:
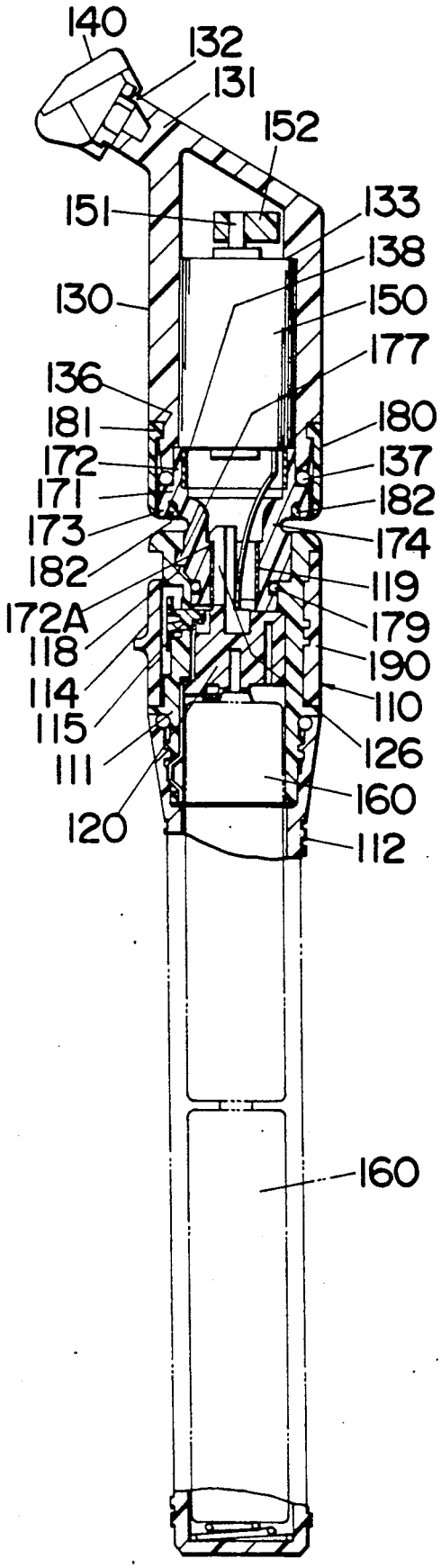
FIG. 9 is a side view, partly in section, of the razor.

FIGS. 5 to 7 illustrate an oscillating razor in accordance with the second embodiment of the present invention which is basically similar to the first embodiment and comprises a grip housing 110 and a shaver head 130 movably supported to the grip housing 110 by means of a damper member 170. The shaver head 130 is of generally hollow cylindrical configuration and is formed at its upper end with an integral nose 131 which extends upwardly and forwardly at an angle of about 45° with respect to a vertical axis of the shaver head 130. The nose 131 terminates in a mount socket 132 for detachably receiving a like blade cartridge 140 of commercially available type having a single or twin blade element 141. As shown in FIG. 9, an electric motor 150 is received within the shaver head 130 with its output shaft 151 extending upwardly in coincidence with the vertical axis of the shaver head 130. The motor 150 is fixed in position with its upper end engaged against an internal shoulder 133 at the upper end portion of the shaver head 130 and with its lower end seated upon the upper inserted end of the damper member 170 The output shaft 151 carries an eccentric weight 152 which is driven to rotates for imparting a like oscillatory movement to the shaver head 130 as in the first embodiment such that the shaver head 130 can oscillate with respect to the grip housing 110.

The grip housing 110 comprises a base barrel 111 and a battery holder 112 which are both of generally hollow cylindrical configuration and are connected axially to one another. The battery holder 112 is threadedly engaged at its upper end with the lower end of the base barrel 111 and accommodates therein a pair of batteries 160 which are electrically connected to the motor 150 through an actuator 115. The base barrel 111 has a vertically slidable switch handle 114 Which actuates the actuator 115 for energizing and deenergizing the motor 150. A clasp cover 190 is fitted over the base barrel 111 for connection of the base barrel 111 Or the grip housing 110 to the damper member 170.

Figure 10:
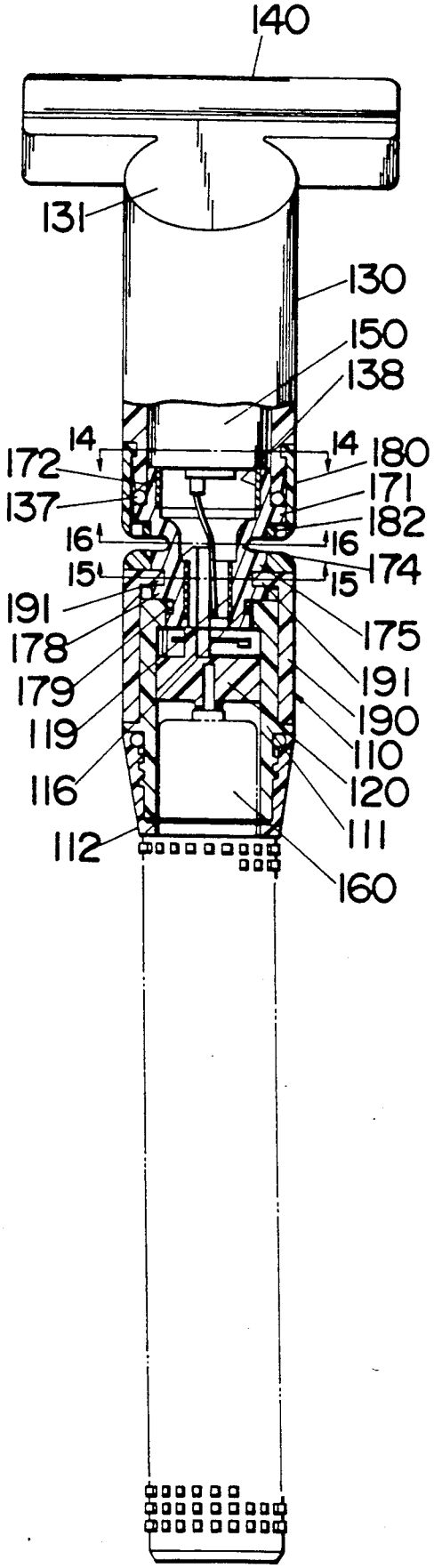
FIG. 10 is a rear view, partly in section, of the razor.
Figure 11:
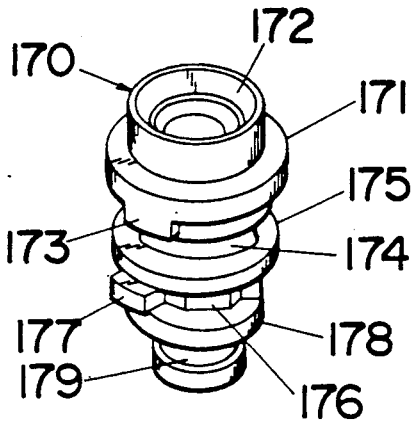
FIG. 11 is a perspective view of a damper member utilized to support a shaver head to a grip housing of the razor.
Figure 12:
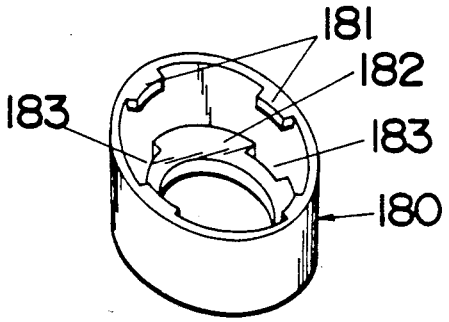
FIG. 12 is a perspective view of a clamp ring utilized to secure the upper end of the damper member to the shaver head.

As best shown in FIG. 11, the damper member 170 is shaped from a rubber or elastomer into a generally hollow cylindrical configuration with upper, middle, and lower annular flanges 171, 175, and 178 respectively extending outwardly and spaced Vertically with each other. The upper flange 171 defines upwardly thereof a tube end 172 which is inserted in the lower opening of the shaver head 130, as shown in FIGS. 9 and 10, and is secured thereto by means of a clamp ring 180 fitted around the lower end portion of the shaver head 130. As shown in FIG. 12, the clamp ring 180 is formed at its upper end with a set of circumferentially spaced and inwardly projecting bayonet lugs 181 and at its lower end With an inward rim 182 with a set of circumferentially spaced slots 183. The bayonet lugs 181 engage into correspondingly formed notches 136 in the lower end of the shaver head 130 with the upper flange 171 of the damper member 170 clamped between the inward rim 182 and the lower end of the shaver head 130 so that the shaver head 130 is coupled to the upper end of the damper member 170. The upper flange 171 includes a set of downwardly projecting catch 173 which are received in Ones of the slots 183 of the rim 182, as seen in FIG. 9, for unrotatively fixing the shaver head 130 to the damper member 170. A seal ring 137 is fitted between the upper flange 171 and the lower end of the shaver head 130 for water-tight sealing therebetween. Also, a metal ring 138 is fitted within the upper tube end 172 to press it against the lower end of the shaver head 130.

Figure 13:
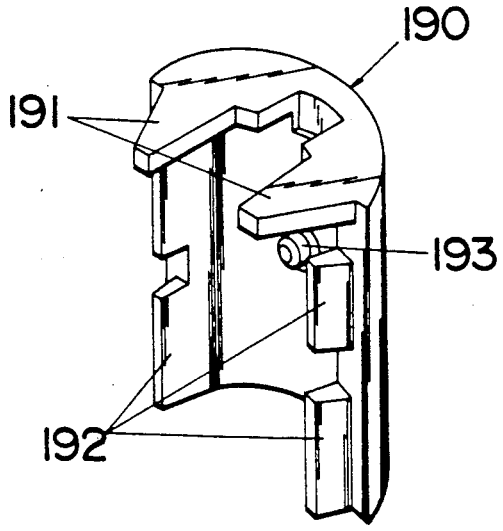
FIG. 13 is a perspective view of a clasp cover utilized to secure the lower end of the damper member to the grip housing.
Figure 14:
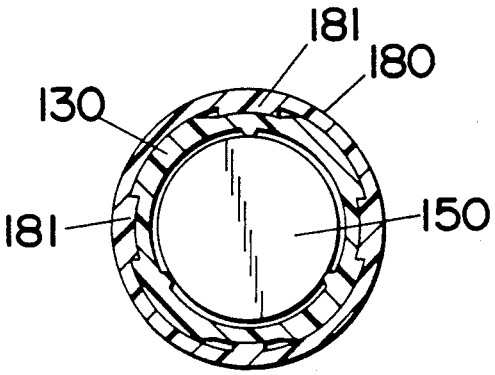
FIG. 14 is a sectional view taken along line 14—14 of FIG. 10.
Figure 15:
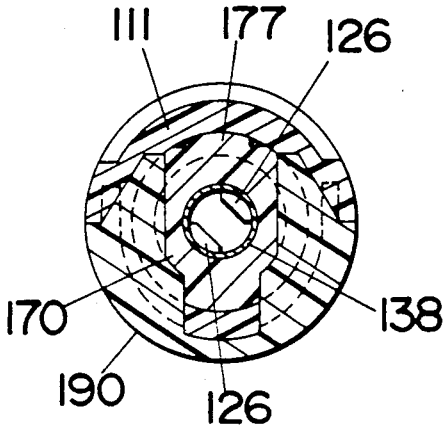
FIG. 15 is a sectional view taken along line 15—15 of FIG. 10.

For connection with the grip housing 110, the lower portion of the damper member 170 including the middle flange 175 is inserted in the top opening of the base barrel 111 and is secured thereto by means of the clasp cover 190 in such a manner to define between the upper and middle flanges 171 and 175 a neck portion 174 which is exposed between the shaver head 130 and the grip housing 110 and responsible for movably supporting the shaver head 130 to the grip housing 110. As shown in FIG. 13, the clasp cover 190 is of generally C-shaped configuration having a pair of inwardly extending tongues 191 at its upper end, a set of side projections 192, and a center projection 193. As best shown in FIG. 10, the clasp cover 90 is fitted around the base barrel 111 with the tongues 191 inserted through the side wall of the base barrel 111 into a groove 176 between the middle and lower flanges 175 and 178 of the damper member 170, while the side and center projections 192 and 193 are press-fitted into corresponding notches (not seen) in the base barrel 111. At this condition, the damper member 170 is unrotatively fixed to the base barrel 111 by engagement of a boss 177 projecting outwardly from the groove 176 into a corresponding notch 118 in the upper opening of the base barrel 111. A seal ring 116 is fitted around an end groove 179 below the lower flange 178 and is pressed against the inside wall of the base barrel 111 to effect a water-tight sealing thereat. A metal ring 119 is fitted within the lower end portion of the damper member 170 to back up the same for secure coupling of the damper member 170 to the base barrel 111.

Figure 16:
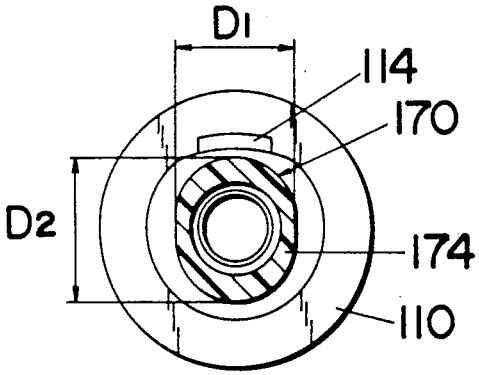
FIG. 16 is a sectional view taken along line 16—16 of FIG. 10.

To minimize the count-vibration which the user feels during the shaving and at the same time to stably but movably support the shaver head 130 On the grip housing 110 for assuring the oscillation of the blade element in the edgewise direction thereof, the neck portion 174 of the damper member 170 is specially designed, as shown in FIG. 16, to have a generally ellipse configuration having a less outside diameter D: in the lengthwise direction than that Dz in the edgewise direction of the blade element while keeping the thickness of the neck portion 174 substantially uniformly therearound. With this arrangement, the neck portion 174 exhibit less elastic modulus in the lengthwise direction than in the edgewise direction of the blade element or the blade cartridge 140, thereby assuring the above requirements just in the same reason as described in the first embodiment. In this connection, the damper member 170 is designed to have like elastic modulus in the respective directions as in the first embodiment.

Figure 17:
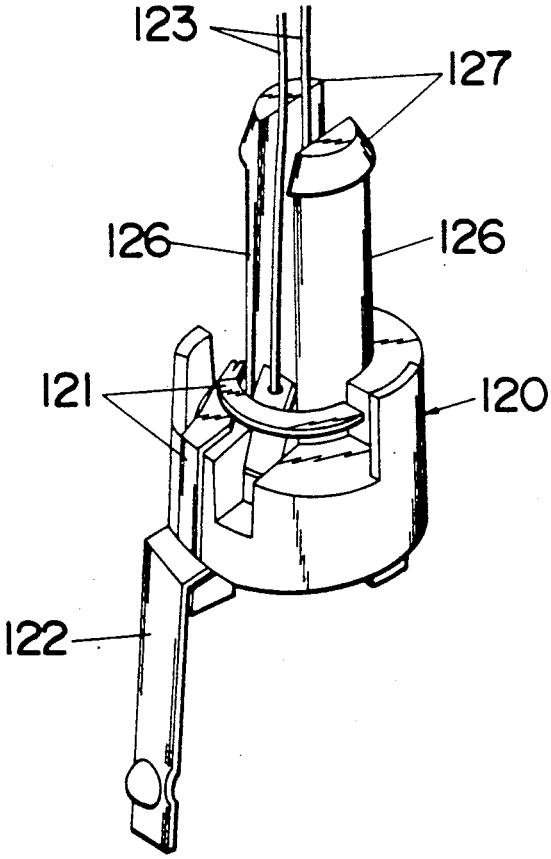
FIG. 17 is a terminal block carrying terminals for electrical interconnection between batteries in the grip housing and a motor in the shaver head.

Received within the base barrel 111 below the damper member 170 is a terminal block 121 which, as shown in FIG. 17, carries a set of switch contacts 121, terminals 122 for connection with the batteries 160, and lead wires 123 extending upwardly through the damper member 170 into the shaver head 130 for connection with the motor 150. One of the switch contacts 121 is operatively connected through an actuator 115 to the switch handle 114 so that it connects and disconnects the motor 150 to and from the batteries 160 upon sliding movement of the switch handle 114. The terminal block 120 also includes a pair of upstanding posts 126 with hooks 127 at the upper ends and is held in position by engaging the hooks 127 respectively with an inner shoulder 172A formed at the damper member 170 interiorly of the middle flange 175 over the metal ring 119, as shown in FIGS. 9 and 10.

Figure 18:
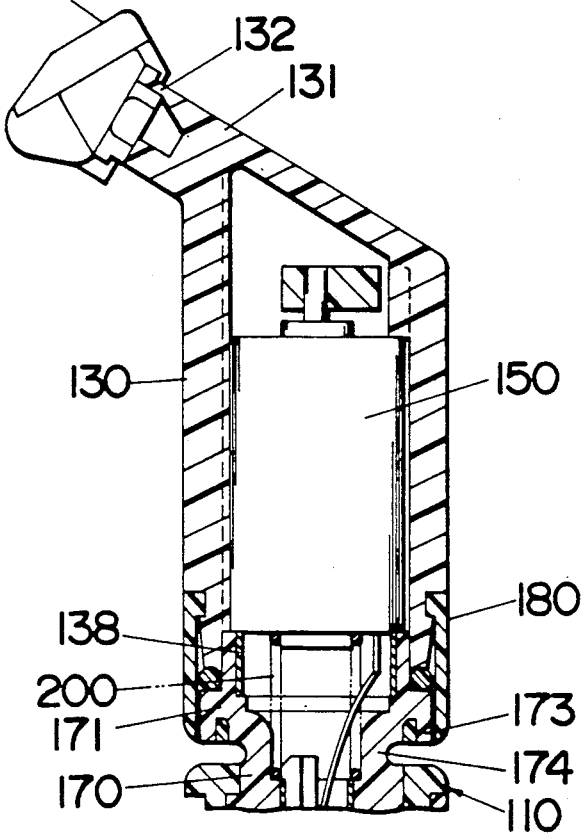
FIG. 18 is a side sectional view of the upper portion of a modified razor of the second embodiment.
Figure 19:
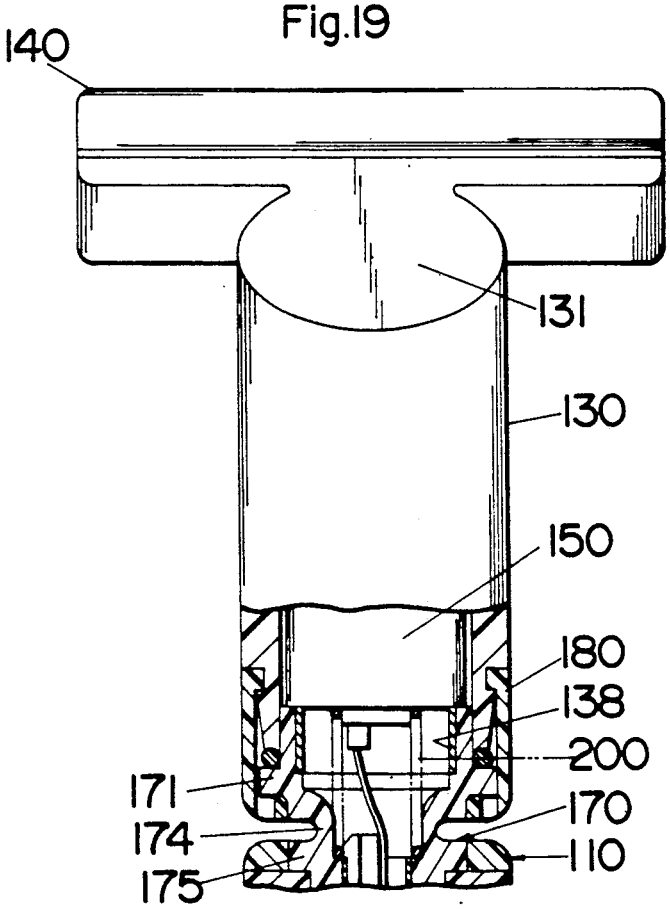
FIG. 19 is a rear view, partially in section, of the upper portion of the modified razor.

A modification of the second embodiment is shown in FIGS. 18 and 19 which is identical in structure to the second embodiment except for a coil spring 200 interposed between the motor 150 and the damper member 170. The upper end of the coil spring 200 is fitted over a center post 155 on the lower end of the motor 150, While the lower end of the coil spring 200 rests upon the inner shoulder 172A of the damper member 170. Thus, the coil spring 200 extends within the damper member 170 past the neck portion 174 upwardly to the motor 150 fixed to the shaver head 130 so that it can reinforce the damper member 170 against excess bend, torsion, and tension forces.

Although the above embodiments disclose the use of the electric rotary motor in combination with the eccentric weight for imparting the oscillatory movement to the shaver head, the present invention should not be understood to be limited thereto and may use other motors including those of solenoid type having an oscillating plunger or the like for generating desired oscillation to the shaver head.

What is claimed is:

1. In a motor-driven oscillating razor comprising:

a grip housing adapted to be gripped by a user;

a shaver head carrying a razor blade element, said shaver head incorporating an oscillation inducing weight;

a damper member singly supporting said shaver head on the top of said grip housing in such a manner that said shaver head is allowed to move with respect to said grip housing;

a motor operatively connected to oscillate said weight for imparting oscillatory movement to said shaver head; and said razor being characterized in that said motor is accommodated within said shaver head in order to isolate an oscillatory system substantially from said grip housing by said damper member such that said shaver head can oscillate substantially independently of said grip housing.

2. A motor-driven oscillating razor as set forth in claim 1, wherein said damper member exhibiting less elastic modulus in the lengthwise direction of said razor blade element than in an edgewise direction thereof.

3. A motor-driven oscillating razor as set forth in claim 2, wherein said damper member is in the form of a hollow cylinder having upper and lower ends secured respectively to said shaver head and said grip housing, said cylinder having a neck portion intermediate said ends which is exposed between said shaver head and said grip housing and responsible for movable support of said shaver head, said neck portion being substantially uniform in thickness and configured to have a less inside diameter along the lengthwise direction of said razor blade element than along the edgewise direction thereof.

4. A motor-driven oscillating razor as set forth in claim 1, wherein said damper member is made of rubber or elastomer to effect water-tight sealing at connections to said shaver head and said grip housing.

5. A motor-driven oscillating razor as set forth in claim 1, wherein said damper member is in the form of a hollow cylinder having upper and lower ends secured respectively to said shaver head and said grip housing, said cylinder having a neck portion intermediate said ends which is exposed between said shaver head and said grip housing and responsible for movable support of said shaver head, said neck portion having an annular flange which restricts an elastic deformation of the damper member.

6. A motor-driven oscillating razor as set forth in claim 1, wherein said motor has an output rotating shaft projecting upwardly in the direction away from said damper member for mounting said weight eccentrically.

7. A motor-driven oscillating razor as set forth in claim 1, wherein said grip housing is provided with a switch handle for energizing and deenergizing said motor.

8. A motor-driven oscillating razor as set forth in claim 1, wherein said damper member is in the form of a hollow cylinder in which a coil spring is held with its upper end connected to said motor and with its lower end supported within said damper member for reinforcing the damper member.

9. A motor-driven oscillating razor as set forth in claim 1, wherein said damper member is in the form of a hollow cylinder having upper and lower ends secured respectively to said shaver head and said grip housing, said cylinder having a neck portion intermediate said ends which is exposed between said shaver head and said grip housing and responsible for movable support of said shaver head, said neck portion being substantially uniform in thickness and configured to have a less outside diameter along the lengthwise direction of said razor blade element than along the edgewise direction thereof.

10. A motor-driven oscillating razor as set forth in claim 1, wherein said damper member is in the form of a hollow cylinder having upper and lower ends secured respectively to said shaver head and said grip housing, said cylinder having a reduced-in-diameter neck portion intermediate said ends which is exposed between said shaver head and said grip housing and responsible for movable support of said shaver head, said upper and lower ends of the damper members inserted respectively in said shaver head and said grip housing and clamped thereat by the use of metal rings which are fitted respectively within said upper and lower ends to press said ends against the corresponding walls of said shaver head and said grip housing.

* * * * *